US007234322B2

(12) United States Patent
Hahn et al.

(10) Patent No.: US 7,234,322 B2
(45) Date of Patent: Jun. 26, 2007

(54) LNG SYSTEM WITH WARM NITROGEN REJECTION

(75) Inventors: Paul R. Hahn, Houston, TX (US); Philip D. Ritchie, Corpus Christi, TX (US); Jame Yao, Sugar Land, TX (US); Rong-Jwyn Lee, Sugar Land, TX (US); Anthony P. Eaton, Sugar Land, TX (US); William R. Low, Bartlesville, OK (US)

(73) Assignee: ConocoPhillips Company, Houston, TX (US)

( * ) Notice: Subject to any disclaimer, the term of this patent is extended or adjusted under 35 U.S.C. 154(b) by 202 days.

(21) Appl. No.: 10/785,808

(22) Filed: Feb. 24, 2004

(65) Prior Publication Data

US 2005/0183452 A1 Aug. 25, 2005

(51) Int. Cl.
*F25J 3/00* (2006.01)

(52) U.S. Cl. ..... 62/620; 62/927

(58) Field of Classification Search ..... 62/620, 62/927

See application file for complete search history.

(56) References Cited

U.S. PATENT DOCUMENTS

| | | | | |
|---|---|---|---|---|
| 3,894,856 | A * | 7/1975 | Lofredo et al. | 95/115 |
| 4,225,329 | A | 9/1980 | Bailey et al. | |
| 4,664,686 | A | 5/1987 | Pahade et al. | |
| 4,746,342 | A * | 5/1988 | DeLong et al. | 62/622 |
| 4,761,167 | A * | 8/1988 | Nicholas et al. | 62/626 |
| 5,036,671 | A * | 8/1991 | Nelson et al. | 62/612 |
| 5,047,074 | A * | 9/1991 | MacGregor et al. | 95/155 |
| 5,141,544 | A * | 8/1992 | Butts | 62/628 |
| 5,325,672 | A * | 7/1994 | Forte | 62/632 |
| 5,617,741 | A * | 4/1997 | McNeil et al. | 62/622 |
| 6,070,429 | A * | 6/2000 | Low et al. | 62/612 |
| 6,223,557 | B1 | 5/2001 | Cole | |
| 6,412,302 | B1 | 7/2002 | Foglietta | |
| 6,425,267 | B1 * | 7/2002 | Baker et al. | 62/624 |
| 6,631,626 | B1 | 10/2003 | Hahn | |

* cited by examiner

*Primary Examiner*—William C. Doerrler
(74) *Attorney, Agent, or Firm*—Hovey Williams LLP

(57) ABSTRACT

Natural gas liquefaction system employing an enhanced nitrogen removal system capable of removing nitrogen from a relatively warm natural gas stream.

86 Claims, 2 Drawing Sheets

LNG SYSTEM WITH WARM NITROGEN REJECTION

BACKGROUND OF THE INVENTION

1. Field of the Invention

Figure 1:
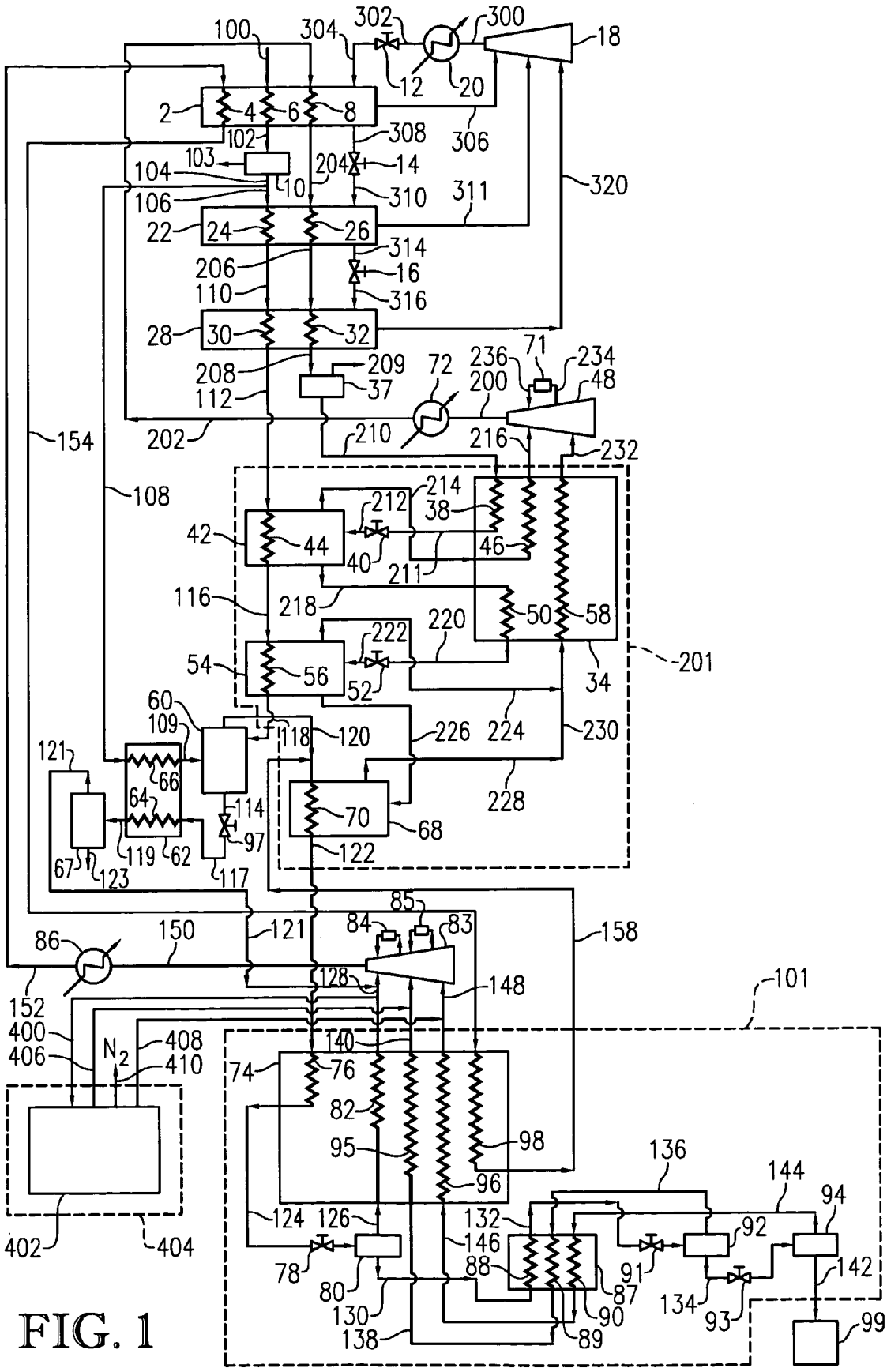

This invention relates to a method and apparatus for liquefying natural gas. In another aspect, the invention concerns an improved liquified natural gas (LNG) facility employing an enhanced nitrogen removal system. In still another aspect, the invention relates to a method and apparatus for removing nitrogen from a relatively warm natural gas stream.

2. Description of the Prior Art

The cryogenic liquefaction of natural gas is routinely practiced as a means of converting natural gas into a more convenient form for transportation and storage. Such liquefaction reduces the volume of the natural gas by about 600-fold and results in a product which can be stored and transported at near atmospheric pressure.

Natural gas is frequently transported by pipeline from the supply source to a distant market. It is desirable to operate the pipeline under a substantially constant and high load factor but often the deliverability or capacity of the pipeline will exceed demand while at other times the demand may exceed the deliverability of the pipeline. In order to shave off the peaks where demand exceeds supply or the valleys when supply exceeds demand, it is desirable to store the excess gas in such a manner that it can be delivered when demand exceeds supply. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source which is separated by great distances from the candidate market and a pipeline either is not available or is impractical. This is particularly true where transport must be made by ocean-going vessels. Ship transportation in the gaseous state is generally not practical because appreciable pressurization is required to significantly reduce the specific volume of the gas. Such pressurization requires the use of more expensive storage containers.

In order to store and transport natural gas in the liquid state, the natural gas is preferably cooled to −240° F. to −260° F. where the liquefied natural gas (LNG) possesses a near-atmospheric vapor pressure. Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by indirect heat exchange with one or more refrigerants such as propane, propylene, ethane, ethylene, methane, nitrogen, carbon dioxide, or combinations of the preceding refrigerants (e.g., mixed refrigerant systems). A liquefaction methodology which is particularly applicable to the current invention employs an open methane cycle for the final refrigeration cycle wherein a pressurized LNG-bearing stream is flashed and the flash vapors (i.e., the flash gas stream(s)) are subsequently employed as cooling agents, recompressed, cooled, combined with the processed natural gas feed stream and liquefied thereby producing the pressurized LNG-bearing stream.

Natural gas streams frequently contain relatively high concentrations of nitrogen. High nitrogen concentrations in natural gas that is subjected to liquefaction in a LNG facility may present one or more of the following drawbacks: (1) the natural gas can be more difficult to condense; (2) the heating value of the natural gas used as fuel gas for the LNG facility's gas turbines can be greatly diminished; and (3) LNG produced by the facility may be out of spec. Thus, many LNG facilities employ nitrogen removal units (NRUs) to lower the concentration of nitrogen in the natural gas stream to an acceptable level. In the past, these NRUs have typically required significant chilling of the NRU feed stream in order to provide effective nitrogen removal.

The requirement that the feed stream to conventional NRUs be significantly chilled has the disadvantage of increasing the total installed cost of the LNG facility. In many conventional LNG facilities, the feed stream to the NRU must be withdrawn from a "cold box" and the reduced-nitrogen product stream from the NRU must be reintroduced into the "cold box." A "cold box" is simply an insulated enclosure that houses a certain group of low-temperature components of a LNG facility. Cold boxes are used because they are less expensive and more efficient than individually insulating each low-temperature component. However, those skilled in the art recognize that each penetration into and out of a cold box complicates the design of the cold box, thereby adding to its cost. In addition, the flow lines between the cold box and NRU of a conventional LNG facility require insulation due to the low temperature of the stream flowing therethrough. Obviously, insulated lines are more expensive to install and maintain than non-insulated lines.

OBJECTS AND SUMMARY OF THE INVENTION

It is, therefore, an object of the present invention to provide a novel natural gas liquefaction system that employs an enhanced nitrogen removal system that can operate relatively independently of the refrigeration cycles of the natural gas liquefaction system.

A further object of the invention is to provide a nitrogen removal system which can effectively remove nitrogen from a relatively warm natural gas stream.

Another object of the invention is to provide an enhanced nitrogen removal system that is less expensive to install and operate than prior systems.

It should be understood that the above objects are exemplary and need not all be accomplished by the invention claimed herein. Other objects and advantages of the invention will be apparent from the written description and drawings.

Accordingly, one aspect of the present invention concerns a method of liquefying a natural gas stream comprising the steps of: (a) warming a predominantly methane stream in a methane cold box to thereby provide a warmed predominantly methane stream; (b) conducting at least a portion of the warmed predominantly methane stream from the methane cold box to a nitrogen removal unit; and (c) removing nitrogen from the warmed predominantly methane stream in the nitrogen removal unit to thereby provide a first nitrogen-reduced stream.

Another aspect of the present invention concerns a method of liquefying a natural gas stream comprising the steps of: (a) cooling the natural gas stream by indirect heat exchange to thereby provide a cooled natural gas stream; (b) reducing the pressure of at least a portion of the cooled natural gas stream to thereby provide an expanded natural gas stream; (c) warming at least a portion of the expanded natural gas stream via indirect heat exchange with the natural gas stream cooled in step (a) to thereby provide a warmed expanded natural gas stream; and (d) removing nitrogen from at least a portion of the warmed expanded liquefied natural gas stream.

A further aspect of the present invention concerns a method of operating a LNG facility comprising the steps of: (a) introducing a warmed predominantly methane stream having a temperature greater than about −50° F. into a nitrogen removal unit; and (b) removing nitrogen from the warmed predominantly methane stream in the nitrogen removal unit.

Still another aspect of the present invention concerns a method of removing nitrogen from a predominantly methane stream comprising the steps of: (a) cooling the predominantly methane stream by indirect heat exchange in a first heat exchanger to thereby provide a first cooled stream; (b) separating at least a portion of the first cooled stream into a first separated stream and a second separated stream using a first vessel, with the first separated stream containing a higher molar percentage of nitrogen than said first cooled stream, and the second separated stream containing a lower molar percentage of nitrogen than said first cooled stream; (c) separating at least a portion of the first separated stream into a third separated stream and a fourth separated stream using a second vessel, with the third separated stream containing a higher molar percentage of nitrogen than the first separated stream, and the fourth separated stream containing a lower molar percentage of nitrogen than the first separated stream; and (d) using at least a portion of the fourth separated stream to cool the predominantly methane stream by indirect heat exchange in the first heat exchanger.

Yet another aspect of the present invention concerns a method of removing nitrogen from a predominantly methane stream comprising the steps of: (a) cooling the predominantly methane stream by indirect heat exchange to thereby provide a first cooled stream; (b) splitting at least a portion of the first cooled stream into a first split portion and a second split portion; (c) conducting at least a portion of the first split portion to a lower section of a first stripper column; (d) further cooling at least a portion of the second split portion by indirect heat exchange to thereby provide a second cooled stream; and (e) conducting at least a portion of the second cooled stream to an upper section of the first stripper column.

Yet a further aspect of the present invention concerns an apparatus for liquefying a predominantly methane stream comprising: (a) a methane cold box including a first cold box inlet and a first cold box outlet; (b) a methane compressor including a first compressor inlet and a first compressor outlet, with the first compressor inlet being configured to receive fluid flow from the first cold box outlet; and (c) a nitrogen removal unit including a nitrogen removal unit inlet configured to receive a drawn-off portion of the predominantly methane stream flowing from the first cold box outlet to the first compressor inlet.

A still further aspect of the present invention concerns an apparatus for removing nitrogen from a predominantly methane stream comprising: (a) a high-stage indirect heat exchanger having a first high-stage cooling pass and a first high-stage warming pass; and (b) a low-stage indirect heat exchanger having a first low-stage cooling pass and a first low-stage warming pass, with the first high-stage warming pass being configured to receive fluid flow from the first low-stage warming pass.

BRIEF DESCRIPTION OF THE DRAWING FIGURES

Figure 2:
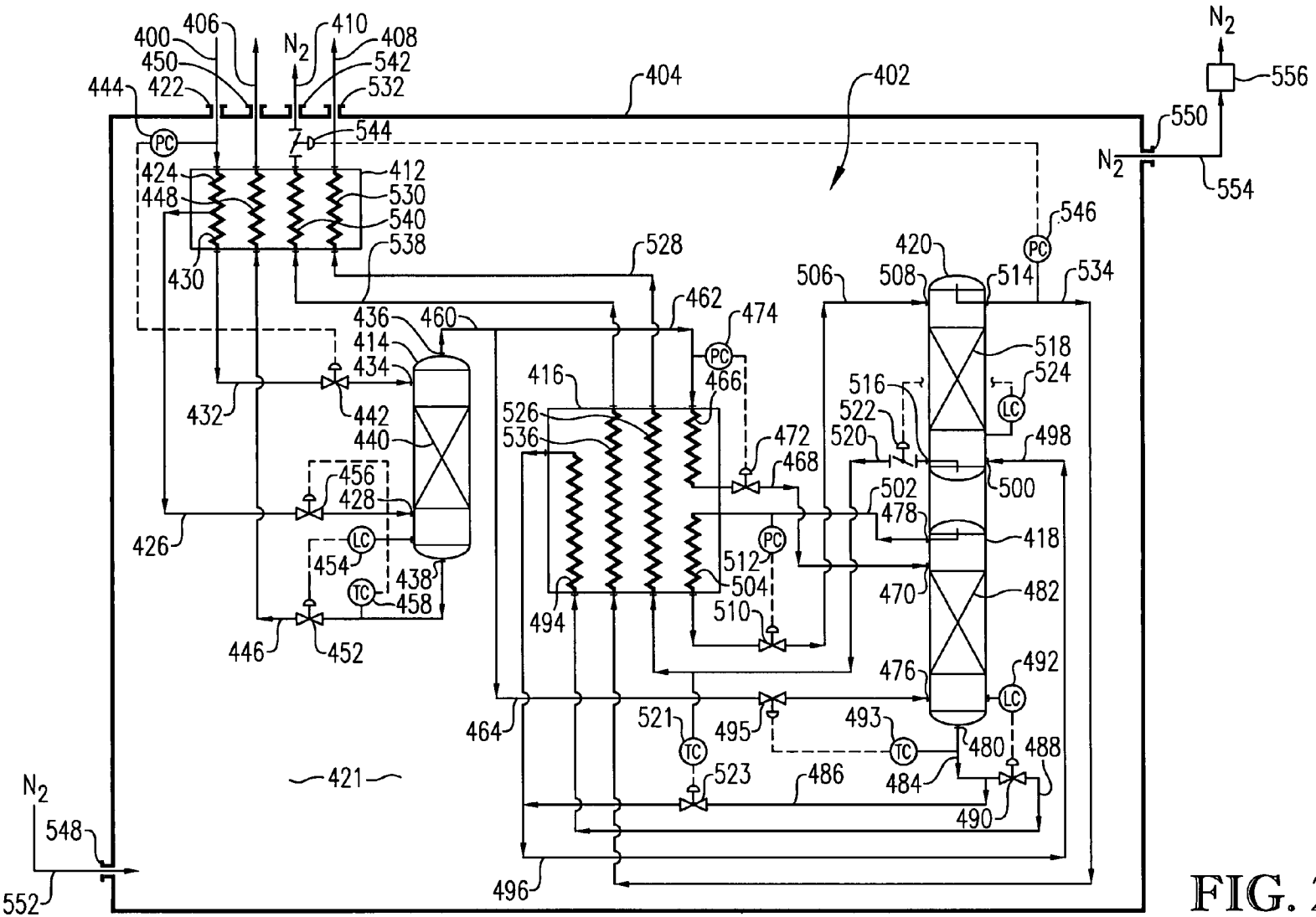

A preferred embodiment of the present invention is described in detail below with reference to the attached drawing figures, wherein:

FIG. 1 is a simplified flow diagram of a cascaded refrigeration process for LNG production which employs an enhanced nitrogen removal system; and FIG. 2 is a more detailed flow diagram of the enhanced nitrogen removal system from FIG. 1.

DETAILED DESCRIPTION OF THE PREFERRED EMBODIMENT

A cascaded refrigeration process uses one or more refrigerants for transferring heat energy from the natural gas stream to the refrigerant and ultimately transferring said heat energy to the environment. In essence, the overall refrigeration system functions as a heat pump by removing heat energy from the natural gas stream as the stream is progressively cooled to lower and lower temperatures. The design of a cascaded refrigeration process involves a balancing of thermodynamic efficiencies and capital costs. In heat transfer processes, thermodynamic irreversibilities are reduced as the temperature gradients between heating and cooling fluids become smaller, but obtaining such small temperature gradients generally requires significant increases in the amount of heat transfer area, major modifications to various process equipment, and the proper selection of flow rates through such equipment so as to ensure that both flow rates and approach and outlet temperatures are compatible with the required heating/cooling duty.

As used herein, the term "open-cycle cascaded refrigeration process" refers to a cascaded refrigeration process comprising at least one closed refrigeration cycle and one open refrigeration cycle where the boiling point of the refrigerant/cooling agent employed in the open cycle is less than the boiling point of the refrigerating agent or agents employed in the closed cycle(s) and a portion of the cooling duty to condense the compressed open-cycle refrigerant/cooling agent is provided by one or more of the closed cycles. In the current invention, a predominately methane stream is employed as the refrigerant/cooling agent in the open cycle. This predominantly methane stream originates from the processed natural gas feed stream and can include the compressed open methane cycle gas streams. As used herein, the terms "predominantly", "primarily", "principally", and "in major portion", when used to describe the presence of a particular component of a fluid stream, shall mean that the fluid stream comprises at least 50 mole percent of the stated component. For example, a "predominantly" methane stream, a "primarily" methane stream, a stream "principally" comprised of methane, or a stream comprised "in major portion" of methane each denote a stream comprising at least 50 mole percent methane.

One of the most efficient and effective means of liquefying natural gas is via an optimized cascade-type operation in combination with expansion-type cooling. Such a liquefaction process involves the cascade-type cooling of a natural gas stream at an elevated pressure, (e.g., about 650 psia) by sequentially cooling the gas stream via passage through a multistage propane cycle, a multistage ethane or ethylene cycle, and an open-end methane cycle which utilizes a portion of the feed gas as a source of methane and which includes therein a multistage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point. As used herein, the terms "upstream" and "downstream" shall be used to describe the relative positions of various components of a natural gas liquefaction plant along the flow path of natural gas through the plant.

Various pretreatment steps provide a means for removing certain undesirable components, such as acid gases, mercaptan, mercury, and moisture from the natural gas feed stream delivered to the LNG facility. The composition of this gas stream may vary significantly. As used herein, a natural gas stream is any stream principally comprised of methane which originates in major portion from a natural gas feed stream, such feed stream for example containing at least 85 mole percent methane, with the balance being ethane, higher hydrocarbons, nitrogen, carbon dioxide, and aminor amount of other contaminants such as mercury, hydrogen sulfide, and mercaptan. The pretreatment steps may be separate steps located either upstream of the cooling cycles or located downstream of one of the early stages of cooling in the initial cycle. The following is a non-inclusive listing of some of the available means which are readily known to one skilled in the art. Acid gases and to a lesser extent mercaptan are routinely removed via a chemical reaction process employing an aqueous amine-bearing solution. This treatment step is generally performed upstream of the cooling stages in the initial cycle. A major portion of the water is routinely removed as a liquid via two-phase gas-liquid separation following gas compression and cooling upstream of the initial cooling cycle and also downstream of the first cooling stage in the initial cooling cycle. Mercury is routinely removed via mercury sorbent beds. Residual amounts of water and acid gases are routinely removed via the use of properly selected sorbent beds such as regenerable molecular sieves.

The pretreated natural gas feed stream is generally delivered to the liquefaction process at an elevated pressure or is compressed to an elevated pressure generally greater than 500 psia, preferably about 500 psia to about 3000 psia, still more preferably about 500 psia to about 1000 psia, still yet more preferably about 600 psia to about 800 psia. The feed stream temperature is typically near ambient to slightly above ambient. A representative temperature range being 60° F. to 150° F.

As previously noted, the natural gas feed stream is cooled in a plurality of multistage cycles or steps (preferably three) by indirect heat exchange with a plurality of different refrigerants (preferably three). The overall cooling efficiency for a given cycle improves as the number of stages increases but this increase in efficiency is accompanied by corresponding increases in net capital cost and process complexity. The feed gas is preferably passed through an effective number of refrigeration stages, nominally two, preferably two to four, and more preferably three stages, in the first closed refrigeration cycle utilizing a relatively high boiling refrigerant. Such relatively high boiling point refrigerant is preferably comprised in major portion of propane, propylene, or mixtures thereof, more preferably the refrigerant comprises at least about 75 mole percent propane, even more preferably at least 90 mole percent propane, and most preferably the refrigerant consists essentially of propane. Thereafter, the processed feed gas flows through an effective number of stages, nominally two, preferably two to four, and more preferably two or three, in a second closed refrigeration cycle in heat exchange with a refrigerant having a lower boiling point. Such lower boiling point refrigerant is preferably comprised in major portion of ethane, ethylene, or mixtures thereof, more preferably the refrigerant comprises at least about 75 mole percent ethylene, even more preferably at least 90 mole percent ethylene, and most preferably the refrigerant consists essentially of ethylene. Each cooling stage comprises a separate cooling zone. As previously noted, the processed natural gas feed stream is preferably combined with one or more recycle streams (i.e., compressed open methane cycle gas streams) at various locations in the second cycle thereby producing a liquefaction stream. In the last stage of the second cooling cycle, the liquefaction stream is condensed (i.e., liquefied) in major portion, preferably in its entirety, thereby producing a pressurized LNG-bearing stream. Generally, the process pressure at this location is only slightly lower than the pressure of the pretreated feed gas to the first stage of the first cycle.

Generally, the natural gas feed stream will contain such quantities of $C_2$+ components so as to result in the formation of a $C_2$+ rich liquid in one or more of the cooling stages. This liquid is removed via gas-liquid separation means, preferably one or more conventional gas-liquid separators. Generally, the sequential cooling of the natural gas in each stage is controlled so as to remove as much of the $C_2$ and higher molecular weight hydrocarbons as possible from the gas to produce a gas stream predominating in methane and a liquid stream containing significant amounts of ethane and heavier components. An effective number of gas/liquid separation means are located at strategic locations downstream of the cooling zones for the removal of liquids streams rich in $C_2$+ components. The exact locations and number of gas/liquid separation means, preferably conventional gas/liquid separators, will be dependant on a number of operating parameters, such as the $C_2$+ composition of the natural gas feed stream, the desired BTU content of the LNG product, the value of the $C_2$+ components for other applications, and other factors routinely considered by those skilled in the art of LNG plant and gas plant operation. The $C_2$+ hydrocarbon stream or streams may be demethanized via a single stage flash or a fractionation column. In the latter case, the resulting methane-rich stream can be directly returned at pressure to the liquefaction process. In the former case, this methane-rich stream can be repressurized and recycle or can be used as fuel gas. The $C_2$+ hydrocarbon stream or streams or the demethanized $C_2$+ hydrocarbon stream may be used as fuel or may be further processed, such as by fractionation in one or more fractionation zones to produce individual streams rich in specific chemical constituents (e.g., $C_2$, $C_3$, $C_4$, and $C_5$+).

The pressurized LNG-bearing stream is then further cooled in a third cycle or step referred to as the open methane cycle via contact in a main methane economizer with flash gases (i.e., flash gas streams) generated in this third cycle in a manner to be described later and via sequential expansion of the pressurized LNG-bearing stream to near atmospheric pressure. The flash gasses used as a refrigerant in the third refrigeration cycle are preferably comprised in major portion of methane, more preferably the flash gas refrigerant comprises at least 75 mole percent methane, still more preferably at least 90 mole percent methane, and most preferably the refrigerant consists essentially of methane. During expansion of the pressurized LNG-bearing stream to near atmospheric pressure, the pressurized LNG-bearing stream is cooled via at least one, preferably two to four, and more preferably three expansions where each expansion employs an expander as a pressure reduction means. Suitable expanders include, for example, either Joule-Thomson expansion valves or hydraulic expanders. The expansion is followed by a separation of the gas-liquid product with a separator. When a hydraulic expander is employed and properly operated, the greater efficiencies associated with the recovery of power, a greater reduction in stream temperature, and the production of less vapor during the flash expansion step will frequently more than off-set the higher capital and operating costs associated with the expander. In one embodiment, additional cooling of the pressurized LNG-bearing stream prior to flashing is made possible by first flashing a portion of this stream via one or more hydraulic expanders and then via indirect heat exchange means employing said flash gas stream to cool the remaining portion of the pressurized LNG-bearing stream prior to flashing. The warmed flash gas stream is then recycled via return to an appropriate location, based on temperature and pressure considerations, in the open methane cycle and will be recompressed.

The liquefaction process described herein may use one of several types of cooling which include but are not limited to (a) indirect heat exchange, (b) vaporization, and (c) expansion or pressure reduction. Indirect heat exchange, as used herein, refers to a process wherein the refrigerant cools the substance to be cooled without actual physical contact between the refrigerating agent and the substance to be cooled. Specific examples of indirect heat exchange means include heat exchange undergone in a shell-and-tube heat exchanger, a core-in-kettle heat exchanger, and a brazed aluminum plate-fin heat exchanger. The physical state of the refrigerant and substance to be cooled can vary depending on the demands of the system and the type of heat exchanger chosen. Thus, a shell-and-tube heat exchanger will typically be utilized where the refrigerating agent is in a liquid state and the substance to be cooled is in a liquid or gaseous state or when one of the substances undergoes a phase change and process conditions do not favor the use of a core-in-kettle heat exchanger. As an example, aluminum and aluminum alloys are preferred materials of construction for the core but such materials may not be suitable for use at the designated process conditions. A plate-fin heat exchanger will typically be utilized where the refrigerant is in a gaseous state and the substance to be cooled is in a liquid or gaseous state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion. Finally, expansion or pressure reduction cooling refers to cooling which occurs when the pressure of a gas, liquid or a two-phase system is decreased by passing through a pressure reduction means. In one embodiment, this expansion means is a Joule-Thomson expansion valve. In another embodiment, the expansion means is either a hydraulic or gas expander. Because expanders recover work energy from the expansion process, lower process stream temperatures are possible upon expansion.

The flow schematic and apparatus set forth in FIG. 1 represents a preferred embodiment of the inventive LNG facility employing an enhanced nitrogen removal system. FIG. 2 represents a preferred embodiment of the enhanced nitrogen removal system. Those skilled in the art will recognized that FIGS. 1 and 2 are schematics only and, therefore, many items of equipment that would be needed in a commercial plant for successful operation have been omitted for the sake of clarity. Such items might include, for example, compressor controls, flow and level measurements and corresponding controllers, temperature and pressure controls, pumps, motors, filters, additional heat exchangers, and valves, etc. These items would be provided in accordance with standard engineering practice.

To facilitate an understanding of FIGS. 1 and 2, the following numbering nomenclature was employed. Items numbered 1 through 99 are process vessels and equipment which are directly associated with the liquefaction process. Items numbered 100 through 199 correspond to flow lines or conduits which contain predominantly methane streams. Items numbered 200 through 299 correspond to flow lines or conduits which contain predominantly ethylene streams. Items numbered 300 through 399 correspond to flow lines or conduits which contain predominantly propane streams. Items numbered 400 through 599 are vessels, equipment, lines, or conduits of the enhanced nitrogen removal system.

Referring to FIG. 1, gaseous propane is compressed in a multistage (preferably three-stage) compressor 18 driven by a gas turbine driver (not illustrated). The three stages of compression preferably exist in a single unit although each stage of compression may be a separate unit and the units mechanically coupled to be driven by a single driver. Upon compression, the compressed propane is passed through conduit 300 to a cooler 20 where it is cooled and liquefied. A representative pressure and temperature of the liquefied propane refrigerant prior to flashing is about 100° F. and about 190 psia. The stream from cooler 20 is passed through conduit 302 to a pressure reduction means, illustrated as expansion valve 12, wherein the pressure of the liquefied propane is reduced, thereby evaporating or flashing a portion thereof. The resulting two-phase product then flows through conduit 304 into a high-stage propane chiller 2 wherein gaseous methane refrigerant introduced via conduit 152, natural gas feed introduced via conduit 100, and gaseous ethylene refrigerant introduced via conduit 202 are respectively cooled via indirect heat exchange means 4, 6, and 8, thereby producing cooled gas streams respectively produced via conduits 154, 102, and 204. The gas in conduit 154 is fed to a main methane economizer 74 which will be discussed in greater detail in a subsequent section and wherein the stream is cooled via indirect heat exchange means 98. The resulting cooled compressed methane recycle stream produced via conduit 158 is then combined in conduit 120 with the heavies depleted (i.e., light-hydrocarbon rich) vapor stream from a heavies removal column 60 and fed to an ethylene chiller 68.

The propane gas from chiller 2 is returned to compressor 18 through conduit 306. This gas is fed to the high-stage inlet port of compressor 18. The remaining liquid propane is passed through conduit 308, the pressure further reduced by passage through a pressure reduction means, illustrated as expansion valve 14, whereupon an additional portion of the liquefied propane is flashed. The resulting two-phase stream is then fed to an intermediate stage propane chiller 22 through conduit 310, thereby providing a coolant for chiller 22. The cooled feed gas stream from chiller 2 flows via conduit 102 to separation equipment 10 wherein gas and liquid phases are separated. The liquid phase, which can be rich in $C_3$+ components, is removed via conduit 103. The gaseous phase is removed via conduit 104 and then split into two separate streams which are conveyed via conduits 106 and 108. The stream in conduit 106 is fed to propane chiller 22. The stream in conduit 108 becomes the feed to heat exchanger 62 and ultimately becomes the stripping gas to heavies removal column 60, discussed in more detail below. Ethylene refrigerant from chiller 2 is introduced to chiller 22 via conduit 204. In chiller 22, the feed gas stream, also referred to herein as a methane-rich stream, and the ethylene refrigerant streams are respectively cooled via indirect heat transfer means 24 and 26, thereby producing cooled methane-rich and ethylene refrigerant streams via conduits 110 and 206. The thus evaporated portion of the propane refrigerant is separated and passed through conduit 311 to the intermediate-stage inlet of compressor 18. Liquid propane refrigerant from chiller 22 is removed via conduit 314, flashed across a pressure reduction means, illustrated as expansion valve 16, and then fed to a low-stage propane chiller/condenser 28 via conduit 316.

As illustrated in FIG. 1, the methane-rich stream flows from intermediate-stage propane chiller 22 to the low-stage propane chiller 28 via conduit 110. In chiller 28, the stream is cooled via indirect heat exchange means 30. In a like manner, the ethylene refrigerant stream flows from the intermediate-stage propane chiller 22 to low-stage propane chiller 28 via conduit 206. In the latter, the ethylene refrigerant is totally condensed or condensed in nearly its entirety via indirect heat exchange means 32. The vaporized propane is removed from low-stage propane chiller 28 and returned to the low-stage inlet of compressor 18 via conduit 320.

As illustrated in FIG. 1, the methane-rich stream exiting low-stage propane chiller 28 is introduced to high-stage ethylene chiller 42 via conduit 112. Ethylene refrigerant exits low-stage propane chiller 28 via conduit 208 and is preferably fed to a separation vessel 37 wherein light components are removed via conduit 209 and condensed ethylene is removed via conduit 210. The ethylene refrigerant at this location in the process is generally at a temperature of about −24° F. and a pressure of about 285 psia. The ethylene refrigerant then flows to an ethylene economizer 34 wherein it is cooled via indirect heat exchange means 38, removed via conduit 211, and passed to a pressure reduction means, illustrated as an expansion valve 40, whereupon the refrigerant is flashed to a preselected temperature and pressure and fed to high-stage ethylene chiller 42 via conduit 212. Vapor is removed from chiller 42 via conduit 214 and routed to ethylene economizer 34 wherein the vapor functions as a coolant via indirect heat exchange means 46. The ethylene vapor is then removed from ethylene economizer 34 via conduit 216 and fed to the high-stage inlet of ethylene compressor 48. The ethylene refrigerant which is not vaporized in high-stage ethylene chiller 42 is removed via conduit 218 and returned to ethylene economizer 34 for further cooling via indirect heat exchange means 50, removed from ethylene economizer via conduit 220, and flashed in a pressure reduction means, illustrated as expansion valve 52, whereupon the resulting two-phase product is introduced into a low-stage ethylene chiller 54 via conduit 222.

After cooling in indirect heat exchange means 44, the methane-rich stream is removed from high-stage ethylene chiller 42 via conduit 116. This stream is then condensed in part via cooling provided by indirect heat exchange means 56 in low-stage ethylene chiller 54, thereby producing a two-phase stream which flows via conduit 118 to heavies removal column 60. As previously noted, the methane-rich stream in line 104 was split so as to flow via conduits 106 and 108. The contents of conduit 108, which is referred to herein as the stripping gas, is first fed to heat exchanger 62 wherein this stream is cooled via indirect heat exchange means 66 thereby becoming a cooled stripping gas stream which then flows via conduit 109 to heavies removal column 60. A heavies-rich liquid stream containing a significant concentration of $C_4$+ hydrocarbons, such as benzene, cyclohexane, other aromatics, and/or heavier hydrocarbon components, is removed from heavies removal column 60 via conduit 114, preferably flashed via a flow control means 97, preferably a control valve which can also function as a pressure reduction, and transported to heat exchanger 62 via conduit 117. Preferably, the stream flashed via flow control means 97 is flashed to a pressure about or greater than the pressure at the high stage inlet port to methane compressor 83. Flashing also imparts greater cooling capacity to the stream. In heat exchanger 62, the stream delivered by conduit 117 provides cooling capabilities via indirect heat exchange means 64 and exits heat exchanger 62 via conduit 119. In heavies removal column 60, the two-phase stream introduced via conduit 118 is contacted with the cooled stripping gas stream introduced via conduit 109 in a countercurrent manner thereby producing a heavies-depleted vapor stream via conduit 120 and a heavies-rich liquid stream via conduit 114.

The heavies-rich stream in conduit 119 is subsequently separated into liquid and vapor portions or preferably is flashed or fractionated in vessel 67. In either case, a heavies-rich liquid stream is produced via conduit 123 and a second methane-rich vapor stream is produced via conduit 121. In the preferred embodiment, which is illustrated in FIG. 1, the stream in conduit 121 is subsequently combined with a second stream delivered via conduit 128, and the combined stream fed to the high-stage inlet port of the methane compressor 83.

As previously noted, the gas in conduit 154 is fed to main methane economizer 74 wherein the stream is cooled via indirect heat exchange means 98. The resulting cooled compressed methane recycle or refrigerant stream in conduit 158 is combined in the preferred embodiment with the heavies-depleted vapor stream from heavies removal column 60, delivered via conduit 120, and fed to a low-stage ethylene chiller 68. In low-stage ethylene chiller 68, this stream is cooled and condensed via indirect heat exchange means 70 with the liquid effluent from valve 222 which is routed to low-stage ethylene chiller 68 via conduit 226. The condensed methane-rich product from low-stage condenser 68 is produced via conduit 122. The vapor from low-stage ethylene chiller 54, withdrawn via conduit 224, and low-stage ethylene chiller 68, withdrawn via conduit 228, are combined and routed, via conduit 230, to ethylene economizer 34 wherein the vapors function as a coolant via indirect heat exchange means 58. The stream is then routed via conduit 232 from ethylene economizer 34 to the low-stage inlet of ethylene compressor 48.

As noted in FIG. 1, the compressor effluent from vapor introduced via the low-stage side of ethylene compressor 48 is removed via conduit 234, cooled via inter-stage cooler 71, and returned to compressor 48 via conduit 236 for injection with the high-stage stream present in conduit 216. Preferably, the two-stages are a single module although they may each be a separate module and the modules mechanically coupled to a common driver. The compressed ethylene product from compressor 48 is routed to a downstream cooler 72 via conduit 200. The product from cooler 72 flows via conduit 202 and is introduced, as previously discussed, to high-stage propane chiller 2.

The pressurized LNG-bearing stream, preferably a liquid stream in its entirety, in conduit 122 is preferably at a temperature in the range of from about −200 to about −50° F., more preferably in the range of from about −175 to about −100° F., most preferably in the range of from −150 to −125° F. The pressure of the stream in conduit 122 is preferably in the range of from about 500 to about 700 psia, most preferably in the range of from 550 to 725 psia.

The stream in conduit 122 is directed to a main methane economizer 74 wherein the stream is further cooled by indirect heat exchange means/heat exchanger pass 76 as hereinafter explained. It is preferred for main methane economizer 74 to include a plurality of heat exchanger passes which provide for the indirect exchange of heat between various predominantly methane streams in the economizer 74. Preferably, methane economizer 74 comprises one or more plate-fin heat exchangers. The cooled stream from heat exchanger pass 76 exits methane economizer 74 via conduit 124. It is preferred for the temperature of the stream in conduit 124 to be at least about 10° F. less than the temperature of the stream in conduit 122, more preferably at least about 25° F. less than the temperature of the stream in conduit 122. Most preferably, the temperature of the stream in conduit 124 is in the range of from about −200 to about −160° F. The pressure of the stream in conduit 124 is then reduced by a pressure reduction means, illustrated as expansion valve 78, which evaporates or flashes a portion of the gas stream thereby generating a two-phase stream. The two-phase stream from expansion valve 78 is then passed to high-stage methane flash drum 80 where it is separated into a flash gas stream discharged through conduit 126 and a liquid phase stream (i.e., pressurized LNG-bearing stream) discharged through conduit 130. The flash gas stream is then transferred to main methane economizer 74 via conduit 126 wherein the stream functions as a coolant in heat exchanger pass 82 and aids in the cooling of the stream in heat exchanger pass 76. Thus, the predominantly methane stream in heat exchanger pass 82 is warmed, at least in part, by indirect heat exchange with the predominantly methane stream in heat exchanger pass 76. The warmed stream exits heat exchanger pass 82 and methane economizer 74 via conduit 128. It is preferred for the temperature of the warmed predominantly methane stream exiting heat exchanger pass 82 via conduit 128 to be at least about 10° F. greater than the temperature of the stream in conduit 124, more preferably at least about 25° F. greater than the temperature of the stream in conduit 124. The temperature of the stream exiting heat exchanger pass 82 via conduit 128 is preferably warmer than about −50° F., more preferably warmer than about 0° F., still more preferably warmer than about 25° F., and most preferably in the range of from 40 to 100° F.

As shown in FIG. 1, a portion of the predominantly methane stream flowing from indirect heat exchanger pass 82 in methane economizer 74 to the high-stage inlet of methane compressor 83 is drawn off of conduit 128 and conducted to a nitrogen removal unit (NRU) 402 via conduit 400. The amount of the predominantly methane stream drawn off of conduit 128 via conduit 400 may vary depending upon the concentration of nitrogen in the predominantly methane stream in conduit 128, as well as various other operating parameters of the LNG facility. Preferably, at least about 5 mole percent of the predominantly methane stream exiting heat exchanger pass 82 via conduit 128 is drawn off by conduit 400, more preferably at least about 10 mole percent of the predominantly methane stream is drawn off by conduit 400, and most preferably at least 25 mole percent of the predominantly methane stream is drawn off by conduit 400. Preferably, at least about 10 mole percent of the predominantly methane stream exiting heat exchanger pass 82 via conduit 128 continues on (past the location at which a portion of the stream is drawn off of conduit 128 by conduit 400) to the high-stage inlet of methane compressor 83, more preferably at least about 35 mole percent of the predominantly methane stream continues on to methane compressor 83, and most preferably at least 50 mole percent of the predominantly methane stream continues on to methane compressor 83.

It is worth noting that the side-draw location, where a portion of the stream in conduit 128 is drawn off for nitrogen removal, is outside of the methane cold box 101. By using a relatively warm stream outside of methane cold box 101 as the feed stream to NRU 402, the expense of removing and re-injecting a stream through the wall of methane cold box 101 is avoided. Further, the elevated temperature of the stream in conduit 400 eliminates the need for insulating conduit 400. As used herein, the term "cold box" shall denote an insulated enclosure housing a plurality of components within which a relatively cold fluid stream is processed. As used herein, the term "methane cold box" shall denote a cold box within which predominantly methane streams are employed to cool a natural gas stream. As used herein, the term "ethylene cold box" shall denote a cold box within which predominantly ethylene streams are employed to cool a natural gas stream. As used herein, the term "nitrogen cold box" shall denote a cold box housing equipment for removing nitrogen from a natural gas stream. Methane cold box 101 preferably houses methane economizer 74, as well as the various sequential expansion and separation components of the expansion-type cooling cycle. Ethylene cold box 201 preferably houses ethylene economizer 34, as well as the various chillers 42, 54, 58, which employ a predominantly ethylene refrigerant to cool the natural gas stream. It is preferred for NRU 402 to be housed in a nitrogen cold box 404, described in detail below with reference to FIG. 2.

In NRU 402, a significant portion of the nitrogen present in the predominantly methane stream in conduit 400 is removed and the removed-nitrogen (i.e., nitrogen-rich) stream exits NRU 402 via conduit 410. NRU 402 also produces a first nitrogen-reduced (i.e., nitrogen-depleted) stream exiting NRU 402 via conduit 406 and a second nitrogen-reduced (i.e., nitrogen-depleted) stream exiting NRU 402 via conduit 408. The first nitrogen-reduced stream in conduit 406 is combined, outside of methane cold box 101, with the warmed predominantly methane stream flowing from heat exchanger pass 95 of methane economizer 74 to the intermediate-stage inlet of methane compressor 83 via conduit 140. The second nitrogen-reduced stream in conduit 408 is combined, outside of methane cold box 101, with the warmed predominantly methane stream flowing from heat exchanger pass 96 of methane economizer 74 to the low-stage inlet of methane compressor 83 via conduit 148. The operation of NRU 402 will be described in detail below with reference to FIG. 2.

The liquid-phase stream exiting high-stage flash drum 80 via conduit 130 is passed through a second methane economizer 87 wherein the liquid is further cooled by downstream flash vapors via indirect heat exchange means 88. The cooled liquid exits second methane economizer 87 via conduit 132 and is expanded or flashed via pressure reduction means, illustrated as expansion valve 91, to further reduce the pressure and, at the same time, vaporize a second portion thereof. This two-phase stream is then passed to an intermediate-stage methane flash drum 92 where the stream is separated into a gas phase passing through conduit 136 and a liquid phase passing through conduit 134. The gas phase flows through conduit 136 to second methane economizer 87 wherein the vapor cools the liquid introduced to economizer 87 via conduit 130 via indirect heat exchanger means 89. Conduit 138 serves as a flow conduit between indirect heat exchange means 89 in second methane economizer 87 and heat exchanger pass 95 in main methane economizer 74. The warmed vapor stream from heat exchanger pass 95 exits main methane economizer 74 via conduit 140, is combined with the first nitrogen-reduced stream in conduit 406, and the combined stream is conducted to the intermediate-stage inlet of methane compressor 83.

The liquid phase exiting intermediate-stage flash drum 92 via conduit 134 is further reduced in pressure by passage through a pressure reduction means, illustrated as a expansion valve 93. Again, a third portion of the liquefied gas is evaporated or flashed. The two-phase stream from expansion valve 93 are passed to a final or low-stage flash drum 94. In flash drum 94, a vapor phase is separated and passed through conduit 144 to second methane economizer 87 wherein the vapor functions as a coolant via indirect heat exchange means 90, exits second methane economizer 87 via conduit 146, which is connected to the first methane economizer 74 wherein the vapor functions as a coolant via heat exchanger pass 96. The warmed vapor stream from heat exchanger pass 96 exits main methane economizer 74 via conduit 148, is combined with the second nitrogen-reduced stream in conduit 408, and the combined stream is conducted to the low-stage inlet of compressor 83.

The liquefied natural gas product from low-stage flash drum 94, which is at approximately atmospheric pressure, is passed through conduit 142 to a LNG storage tank 99. In accordance with conventional practice, the liquefied natural gas in storage tank 99 can be transported to a desired location (typically via an ocean-going LNG tanker). The LNG can then be vaporized at an onshore LNG terminal for transport in the gaseous state via conventional natural gas pipelines.

As shown in FIG. 1, the high, intermediate, and low stages of compressor 83 are preferably combined as single unit. However, each stage may exist as a separate unit where the units are mechanically coupled together to be driven by a single driver. The compressed gas from the low-stage section passes through an inter-stage cooler 85 and is combined with the intermediate pressure gas in conduit 140 prior to the second-stage of compression. The compressed gas from the intermediate stage of compressor 83 is passed through an inter-stage cooler 84 and is combined with the high pressure gas provided via conduits 121 and 128 prior to the third-stage of compression. The compressed gas (i.e., compressed open methane cycle gas stream) is discharged from high stage methane compressor through conduit 150, is cooled in cooler 86, and is routed to the high pressure propane chiller 2 via conduit 152 as previously discussed. The stream is cooled in chiller 2 via indirect heat exchange means 4 and flows to main methane economizer 74 via conduit 154. The compressed open methane cycle gas stream from chiller 2 which enters the main methane economizer 74 undergoes cooling in its entirety via flow through indirect heat exchange means 98. This cooled stream is then removed via conduit 158 and combined with the processed natural gas feed stream upstream of the first stage of ethylene cooling.

Referring now to FIG. 2, NRU 402 generally includes a high-stage heat exchanger 412, a high-stage vessel 414, a low-stage heat exchanger 416, an intermediate-stage vessel 418, and a low-stage vessel 420. These main components of NRU 402 are preferably enclosed within nitrogen cold box 404 and surrounded by a loose/flowable insulating material 421 (e.g., perlite) that substantially fills cold box 404. Heat exchangers 412,416 are preferably plate-fin indirect heat exchangers that are provided with a plurality of indirect heat exchanger passes for facilitating heat transfer between various fluid streams. Vessels 414,418,420 are preferably stripper columns having an having an upper portion and lower portion, with the upper portion including an upper inlet and an upper outlet, while the lower portion includes a lower inlet and a lower outlet. Preferably, a contact-enhancing structure (e.g., internal packing) is vertically disposed in the stripper column between the upper portion of the column and the lower portion of the column.

The warmed predominantly methane stream in conduit 400 enters nitrogen cold box 404 via cold box inlet 422. It is preferred for the stream in conduit 400 to have a temperature of at least about −50° F., more preferably at least about 0° F., still more preferably at least 25° F., and most preferably in the range of 40 to 100° F. Typically, the stream in conduit 400 has a nitrogen concentration of at least about 0.5 mole percent, more typically at least about 2 mole percent, even more typically at least about 10 mole percent, and generally in the range of from 2 to 40 mole percent nitrogen. The stream in conduit 400 is initially conducted to high-stage heat exchanger 412 for cooling in a first cooling heat exchanger pass 424. After cooling in heat exchanger pass 424, a first portion of the cooled stream is conducted via conduit 426 to a lower inlet 428 of high-stage vessel 414. The second portion of the stream cooled in heat exchanger pass 424 that is not removed via conduit 426 enters a second cooling heat exchanger pass 430 for further cooling. The cooled stream exiting heat exchanger pass 430 is conducted via conduit 432 to an upper inlet 434 of high-stage vessel 414. It is preferred for at least about 5 mole percent of the stream cooled in heat exchanger pass 424 to be conducted to lower inlet 428 of high-stage vessel 414 via conduit 426, more preferably at least about 10 mole percent of the stream exiting in heat exchanger pass 424 is conducted to lower inlet 428, and most preferably at least 35 mole percent of the stream exiting in heat exchanger pass 424 is conducted to lower inlet 428. It is preferred for the temperature of the stream carried in conduit 426 to be at least about 50° F. cooler than the temperature of the stream entering heat exchanger pass 424 via conduit 400, more preferably the temperature of the stream carried in conduit 426 is at least about 75° F. cooler than the temperature of the stream entering heat exchanger pass 424, most preferably the temperature of the stream carried in conduit 426 is at least 100° F. cooler than the temperature of the stream entering heat exchanger pass 424. It is preferred for the temperature of the stream carried in conduit 426 to be just above its dew point temperature. Preferably, the temperature of the stream in conduit 426 is within about 50° F. of its dew point temperature, most preferably within 20° F. of its dew point temperature. It is preferred for the temperature of the stream carried in conduit 432 to be at least about 10° F. cooler than the stream in conduit 426, more preferably at least about 25° F. cooler than the stream in conduit 426, and most preferably at least 40° F. cooler than the stream in conduit 426.

High-stage vessel 414 preferably includes an upper outlet 436, a lower outlet 438, and internal packing 440 disposed between upper and lower outlets 436,438. In high-stage vessel 414, the cooled streams entering via upper and lower inlets 434,428 are separated into a first separated stream exiting vessel 414 via upper outlet 436 and conduit 460 and a second separated stream exiting vessel 414 via lower outlet 438 and conduit 446. It is preferred for the first separated stream in conduit 460 to contain a higher molar percentage of nitrogen than the streams entering vessel 414 via upper and lower inlets 434,428. More preferably, the first separated stream in conduit 460 contains at least 50 percent more nitrogen (by mole) than the streams entering vessel 414 via upper and lower inlets 434,428. For example, if the streams entering vessel 414 via upper and lower inlets 434,428 each have a nitrogen concentration of 20 mole percent, it is preferred for the first separated stream in conduit 460 to contain at least 30 mole percent nitrogen (i.e., a 50 percent greater molar concentration of nitrogen than the streams entering vessel 414 via upper and lower inlets 434,428). Most preferably, the first separated stream in conduit 460 contains at least 100 percent more nitrogen (by mole) than the streams entering vessel 414 via upper and lower inlets 434,428. It is preferred for the second separated stream in conduit 446 to contain a lower molar percentage of nitrogen than the streams entering vessel 414 via upper and lower inlets 434,428. More preferably, the second separated stream in conduit 446 contains at least 50 percent less nitrogen (by mole) than the streams entering vessel 414 via upper and lower inlets 434,428. For example, if the streams entering vessel 414 via upper and lower inlets 434,428 each have a nitrogen concentration of 20 mole percent, it is preferred for the second separated stream in conduit 446 to contain less than 10 mole percent nitrogen (i.e., at least 50 percent less than the 20 mole percent nitrogen concentration in the streams entering vessel 414 via upper and lower inlets 434,428). Most preferably, the second separated stream in conduit 446 contains at least 75 percent less nitrogen (by mole) than the streams entering vessel 414 via upper and lower inlets 434,428.

The second separated stream in conduit 446 is carried to a first warming heat exchanger pass 448 of high-stage heat exchanger 412 wherein the second separated stream acts as a coolant to reduce the temperature of the stream(s) in heat exchanger pass(es) 424 and/or 430 of heat exchanger 412. The warmed stream exiting heat exchanger pass 448 via conduit 406 exits nitrogen cold box 404 via first cold box outlet 450.

The feed rate of the predominantly methane stream into upper inlet 434 of high-stage vessel 414 is controlled by a control valve 442 disposed in conduit 432. Control valve 442 is controlled via a pressure controller 444 that reads the pressure in conduit 440 and adjusts the position of control valve 442 accordingly. The feed rate of the predominantly methane stream into lower inlet 428 of high-stage vessel 414 is controlled by a control valve 456 disposed in conduit 426. Control valve 456 is controlled via a temperature controller 458 that reads the temperature in conduit 446 and adjusts the position of control valve 456 accordingly. The flow rate of the second separated stream through conduit 446 is controlled by a control valve 452 disposed in conduit 446. Control valve 452 is controlled via a level controller 454 which senses the liquid level in high-stage vessel 414 and adjusts control valve 452 accordingly.

The first separated stream in conduit 460 is split into a first portion passing through conduit 462 and a second portion passing through conduit 464. It is preferred for the stream carried in conduit 460 to be split in a manner such that conduits 462 and 464 each carry at least about 5 mole percent of the stream from conduit 460, more preferably conduits 462 and 464 each carry at least about 10 mole percent of the stream from conduit 460, and most preferably conduits 462 and 464 each carry at least 25 mole percent of the stream from conduit 460. The first portion of the split stream is conducted via conduit 462 to a first cooling heat exchanger pass 466 in low-stage heat exchanger 416. In heat exchanger pass 466 the stream is cooled via indirect heat exchange and exits heat exchanger pass 466 and heat exchanger 416 via conduit 468. The temperature of the cooled stream in conduit 468 is preferably at least about 10° F. cooler than the temperature of the stream in conduit 462, more preferably at least 25° F. cooler than the stream in conduit 462. The cooled stream in conduit 468 is conducted to an upper inlet 470 of intermediate-stage vessel 418. The flow rate of the stream entering vessel 418 via upper inlet 470 is controlled by a control valve 472 disposed in conduit 468. A pressure controller 474 reads the pressure in conduit 462 and adjusts control valve 472 accordingly.

The second portion of the split stream from conduit 460 is conducted via conduit 464 to a lower inlet 476 of intermediate-stage vessel 418. The function and configuration of intermediate-stage vessel 418 is similar to the function and configuration of high-stage vessel 414. Thus, intermediate-stage vessel 418 includes an upper outlet 478, a lower outlet 480, and internal packing 482 disposed between upper and lower outlets 478,480. Intermediate-stage vessel 418 is operable to separate the streams entering vessel 418 via upper and lower inlets 470,476 into a first separated stream exiting vessel 418 via upper outlet 478 and a second separated stream exiting vessel 418 via lower outlet 480. It is preferred for the first separated stream exiting vessel 418 via upper outlet 478 to contain a higher concentration of nitrogen than the streams entering vessel 418 via upper and lower inlets 470, 476. More preferably, the first separated stream exiting vessel 418 via upper outlet 478 contains at least 50 percent more nitrogen (by mole) than the streams entering vessel 418 via upper and lower inlets 470,476. Most preferably, the first separated stream exiting vessel 418 via upper outlet 478 contains at least 100 percent more nitrogen (by mole) than the streams entering vessel 418 via upper and lower inlets 470,476. It is preferred for the second separated stream exiting vessel 418 via lower outlet 480 to contain a lower concentration of nitrogen than the streams entering vessel 418 via upper and lower inlets 470,476. More preferably, the second separated stream exiting vessel 418 via lower outlet 480 contains at least 15 percent less nitrogen (by mole) than the streams entering vessel 418 via upper and lower inlets 470,476. Most preferably, the second separated stream exiting vessel 418 via lower outlet 480 contains at least 25 percent less nitrogen (by mole) than the streams entering vessel 418 via upper and lower inlets 470,476. The flow rate of the stream entering vessel 418 via conduit 464 is controlled by a control valve 495 disposed in conduit 464. A temperature controller 493 measures the temperature of the second separated stream in conduit 484 and adjusts control valve 495 accordingly.

The second separated stream in conduit 484 is split into a first split portion carried in conduit 486 and a second split portion carried in conduit 488. The relative amount of the second separated stream from conduit 484 that is carried in conduits 486,488 is controlled by a control valve 490. A level controller 492 senses the liquid level in intermediate-stage vessel 418 and adjusts control valve 490 accordingly. The second split portion in conduit 488 is conducted to a second heat exchanger pass 494 of low-stage heat exchanger 416 wherein the second split portion is heated via indirect heat exchange. The heated stream from heat exchanger pass 494 exits low-stage heat exchanger 416 via conduit 496. The heated stream in conduit 496 is preferably at least about 5° F. warmer than the stream in conduit 488, more preferably at least 10° F. warmer than the stream in conduit 488. The heated stream in conduit 496 is then combined with the first split portion in conduit 486, and the combined streams are carried via conduit 498 to a lower inlet 500 of low-stage vessel 420.

The first separated stream from intermediate-stage vessel 418 is conducted from upper outlet 478 via conduit 502. Conduit 502 carries the first separated stream to a third cooling heat exchanger pass 504 of low-stage heat exchanger 416 for cooling via indirect heat exchange. The cooled stream from heat exchanger pass 504 exits heat exchanger 416 via conduit 506 which carries the stream to an upper inlet 508 of high-stage vessel 420. The cooled stream in conduit 506 is preferably at least about 10° F. cooler than the stream in conduit 502, more preferably at least 20° F. cooler than the stream in conduit 502. Conduit 506 carries the cooled stream to upper inlet 508 of low-stage vessel 420. The feed rate of the cooled stream into upper inlet 508 is controlled by a control valve 510 disposed in conduit 506. A pressure controller 512 reads the pressure of the stream in conduit 502 and adjusts control valve 510 accordingly.

The function and configuration of low-stage vessel 420 is similar to the function and configuration of high-stage and intermediate-stage vessels 414,418. Thus, low-stage vessel 420 includes an upper outlet 514, a lower outlet 516, and internal packing 518 disposed between upper and lower outlets 514,516. Low-stage vessel 420 is operable to separate the streams entering vessel 420 via upper and lower inlets 508,500 into a first separated stream exiting vessel 420 via upper outlet 514 and a second separated stream exiting vessel 520 via lower outlet 516. It is preferred for the first separated stream exiting vessel 420 via upper outlet 514 to contain a higher concentration of nitrogen than the streams entering vessel 420 via upper and lower inlets 508,500. More preferably, the first separated stream exiting vessel 420 via upper outlet 514 contains at least 5 percent more nitrogen (by mole) than the streams entering vessel 420 via upper and lower inlets 508,500. Most preferably, the first separated stream exiting vessel 420 via upper outlet 514 contains at least 10 percent more nitrogen (by mole) than the streams entering vessel 420 via upper and lower inlets 508,500. It is preferred for the second separated stream exiting vessel 420 via lower outlet 516 to contain a lower concentration of nitrogen than the streams entering vessel 420 via upper and lower inlets 508,500. More preferably, the second separated stream exiting vessel 420 via lower outlet 516 contains at least 5 percent less nitrogen (by mole) than the streams entering vessel 420 via upper and lower inlets 508,500. Most preferably, the second separated stream exiting vessel 420 via lower outlet 516 contains at least 10 percent less nitrogen (by mole) than the streams entering vessel 420 via upper and lower inlets 508,500.

The second separated stream exiting low-stage vessel 420 via lower outlet 516 is carried in conduit 520. The flow of fluid through conduit 520 is controlled by control valve 522 disposed in conduit 520. A level controller 524 senses the liquid level in low-stage vessel 420 and adjusts control valve 522 accordingly. A temperature controller 521 reads the temperature of the second separated stream in conduit 520 and adjusts a temperature control valve 523 disposed in conduit 486 to thereby control fluid flow through conduit 486. The stream in conduit 520 is introduced into a first warming heat exchanger pass 526 of low-stage heat exchanger 416 wherein the stream is warmed via indirect heat exchange. The warmed stream from heat exchanger pass 526 exits low-stage heat exchanger 416 via conduit 528. It is preferred for the warmed stream in conduit 528 to be at least about 10° F. warmer than the stream in conduit 520, most preferably at least 20° F. warmer than the stream in conduit 520. Conduit 528 carries the warmed stream to a second warming heat exchanger pass 530 of high-stage heat exchanger 412, wherein the stream is warmed via indirect heat exchange with the stream(s) in indirect heat exchanger pass(es) 424 and/or 430. The warmed stream from heat exchanger pass 530 exits high-stage heat exchanger 412 via conduit 408 and exits nitrogen cold box 404 via a second cold box outlet 532. It is preferred for the warmed stream in conduit 408 to be at least about 50° F. warmer than the stream in conduit 528, more preferably at least about 150° F. warmer than the stream in conduit 528, and most preferably at least 250° F. warmer than the stream in conduit 528.

The first separated stream (i.e., the removed-nitrogen stream) exiting low-stage vessel 420 via upper outlet 414 is carried in conduit 534. The first separated stream in conduit 534 preferably contains at least about 10 mole percent nitrogen, more preferably at least about 50 mole percent nitrogen, still more preferably at least about 75 mole percent nitrogen, and most preferably at least 90 mole percent nitrogen. The stream in conduit 534 is introduced into a second warming heat exchanger pass 536 of low-stage heat exchanger 416 wherein the stream is warmed via indirect heat exchange. The warmed stream from heat exchanger pass 536 exits low-stage heat exchanger 416 via conduit 538. It is preferred for the warmed stream in conduit 538 to be at least about 10° F. warmer than the stream in conduit 534, most preferably at least 20° F. warmer than the stream in conduit 534. Conduit 538 carries the warmed stream to a third warming heat exchanger pass 540 of high-stage heat exchanger 412 wherein the stream is warmed via indirect heat exchange with the stream(s) in indirect heat exchanger pass(es) 424 and/or 430. The warmed stream from heat exchanger pass 540 exits high-stage heat exchanger 412 via conduit 410 and exits nitrogen cold box 404 via a third cold box outlet 542. It is preferred for the warmed stream in conduit 410 (i.e., the removed-nitrogen stream) to be at least about 50° F. warmer than the stream in conduit 538, more preferably at least about 150° F. warmer than the stream in conduit 538, and most preferably at least 250° F. warmer than the stream in conduit 538. A control valve 544 is disposed in conduit 410 to control fluid flow there through. A pressure controller 546 measures the pressure in conduit 534 and adjusts control valve 544 accordingly.

It is preferred for the temperatures of the streams exiting high-stage heat exchanger 412 via conduits 406, 408, and 410 to be within about 25° F. of the temperature of the stream in conduit 400, most preferably within 10° F. of the temperature of the stream in conduit 400. Preferably, the temperatures of the streams in conduits 406, 408, and 410 are in the range of from about 0° F. to about 100° F., most preferably in the range of from 25° F. to 75° F. The removed-nitrogen stream in conduit 410 preferably contains at least about 10 mole percent nitrogen, more preferably at least about 50 mole percent nitrogen, still more preferably at least about 75 mole percent nitrogen, and most preferably at least 90 mole percent nitrogen. The nitrogen-reduced streams in conduits 406 and 408 preferably contain less than about 15 mole percent nitrogen, and more preferably less than 8 mole percent nitrogen.

As shown in FIG. 2, nitrogen cold box 404 includes a purging gas inlet 548 and a purging gas outlet 550. In order to ensure that no water accumulates in nitrogen cold box 404, a substantially hydrocarbon-free purging gas is continuously introduced via conduit 552 and inlet 548 into nitrogen cold box 504. The purging gas flows through the interior of nitrogen cold box 404 and exits nitrogen cold box 404 via outlet 550. The purging gas exiting nitrogen cold box 440 via outlet 550 is carried via conduit 554 to a hydrocarbon analyzer at 556. Hydrocarbon analyzer 556 is operable to detect the presence of hydrocarbons in the purging gas. If analyzer 556 detects an unusually high hydrocarbon concentration in the purging gas, this indicates a hydrocarbon leak within nitrogen cold box 404. Referring to FIG. 1, ethylene cold box 201 and methane cold box 101 preferably have a similar configuration to nitrogen cold box 404, shown in FIG. 2.

In one embodiment of the present invention, the LNG production systems illustrated in FIGS. 1 and 2 are simulated on a computer using conventional process simulation software. Examples of suitable simulation software include HYSYS™ from Hyprotech, Aspen Plus® from Aspen Technology, Inc., and PRO/II® from Simulation Sciences Inc.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A method of liquefying a natural gas stream, said method comprising the steps of:
(a) warming a predominantly methane stream in a methane cold box to thereby provide a warmed predominantly methane stream;
(b) conducting at least a portion of the warmed predominantly methane stream from the methane cold box to a nitrogen removal unit; and
(c) removing nitrogen from said at least a portion of the warmed predominantly methane stream in the nitrogen removal unit to thereby provide a first nitrogen-reduced stream,
wherein the temperature of the warmed predominantly methane stream introduced into the nitrogen removal unit is at least about 10° F. warmer than the temperature of said predominantly methane stream subjected to warming in said methane cold box.

2. A method of liquefying a natural gas stream, said method comprising the steps of:
(a) warming a predominantly methane stream in a methane cold box to thereby provide a warmed predominantly methane stream;
(b) conducting at least a portion of the warmed predominantly methane stream from the methane cold box to a nitrogen removal unit;
(c) removing nitrogen from said at least a portion of the warmed predominantly methane stream in the nitrogen removal unit to thereby provide a first nitrogen-reduced stream;
(d) splitting the warmed predominantly methane stream into a first portion and a second portion; and
(e) conducting the first portion to a first inlet of a methane compressor, step (b) including conducting the second portion to the nitrogen removal unit.

3. The method according to claim 2,
said first portion comprising at least about 10 mole percent of the warmed predominantly methane stream,
said second portion comprising at least about 10 mole percent of the warmed predominantly methane stream.

4. The method according to claim 2,
said first portion comprising at least about 35 mole percent of the warmed predominantly stream,
said second portion comprising at least about 35 mole percent of the warmed predominantly methane stream.

5. The method according to claim 2; and
(f) conducting at least a portion of the first nitrogen-reduced stream from the nitrogen removal unit to a second inlet of the methane compressor, said second inlet being spaced from the first inlet.

6. The method according to claim 5; and
(g) step (c) including removing nitrogen from said at least a portion of the warmed predominantly methane stream in the nitrogen removal unit to thereby provide a second nitrogen-reduced stream; and
(h) conducting at least a portion of the second nitrogen-reduced stream from the nitrogen-removal unit to a third inlet of the methane compressor, said third inlet being spaced from the first and second inlets.

7. The method according to claim 6,
said methane compressor being a multi-stage compressor,
said first, second, and third inlets being inlets to respective high-stage, intermediate-stage, and low-stage sections of the methane compressor.

8. A method of liquefying a natural gas stream, said method comprising the steps of:
(a) warming a predominantly methane stream in a methane cold box to thereby provide a warmed predominantly methane stream;
(b) conducting at least a portion of the warmed predominantly methane stream from the methane cold box to a nitrogen removal unit;
(c) removing nitrogen from said at least a portion of the warmed predominantly methane stream in the nitrogen removal unit to thereby provide a first nitrogen-reduced stream; and
(d) upstream of the methane cold box, cooling at least a portion of the predominantly methane stream in a first refrigeration cycle employing a first refrigerant comprising predominantly $C_1$–$C_3$ hydrocarbons, carbon dioxide, or mixtures thereof.

9. The method according to claim 8; and
(e) upstream of the methane cold box and downstream of the first refrigeration cycle, cooling at least a portion of the predominantly methane stream in a second refrigeration cycle employing a second refrigerant comprising predominantly ethane, ethylene, or mixtures thereof,
said first refrigerant comprising predominantly propane, propylene, or mixtures thereof.

10. The method according to claim 1,
said methane cold box housing a methane economizer for facilitating indirect heat transfer between a plurality of predominantly methane streams,
step (a) being carried out in the methane economizer.

11. The method according to claim 10,
said methane cold box housing an expansion-type cooling cycle.

12. The method according to claim 11,
said expansion-type cooling cycle employing a plurality of expanders for sequentially reducing the pressure of the predominantly methane stream and a plurality of separation vessels for phase-separating the pressure-reduced predominantly methane streams exiting the expanders.

13. The method according to claim 1, said nitrogen removal unit including a nitrogen cold box.

14. A method of liquefying a natural gas stream, said method comprising the steps of:

(a) warming a predominantly methane stream in a methane cold box to thereby provide a warmed predominantly methane stream;

(b) conducting at least a portion of the warmed predominantly methane stream from the methane cold box to a nitrogen removal unit; and (c) removing nitrogen from said at least a portion of the warmed predominantly methane stream in the nitrogen removal unit to thereby provide a first nitrogen-reduced stream, said warmed predominantly methane stream having a temperature of −50° F. or warmer.

15. A method of liquefying a natural gas stream, said method comprising the steps of:

(a) warming a predominantly methane stream in a methane cold box to thereby provide a warmed predominantly methane stream;

(b) conducting at least a portion of the warmed predominantly methane stream from the methane cold box to a nitrogen removal unit; and (c) removing nitrogen from said at least a portion of the warmed predominantly methane stream in the nitrogen removal unit to thereby provide a first nitrogen-reduced stream, said warmed predominantly methane stream having a temperature of 25° F. or warmer.

16. A method of liquefying a natural gas stream, said method comprising the steps of:

(a) warming a predominantly methane stream in a methane cold box to thereby provide a warmed predominantly methane stream;

(b) conducting at least a portion of the warmed predominantly methane stream from the methane cold box to a nitrogen removal unit; and (c) removing nitrogen from said at least a portion of the warmed predominantly methane stream in the nitrogen removal unit to thereby provide a first nitrogen-reduced stream, steps (a), (b), and (c) being are carried out in a cascade-type LNG facility having at least three sequential cooling cycles, each employing a different refrigerant.

17. The method according to claim 16, said cascade-type LNG facility employing an open-methane refrigeration cycle.

18. The method according to claim 1; and (d) vaporizing liquefied natural gas produced via steps (a)–(c).

19. A method of liquefying a natural gas stream, said method comprising the steps of:

(a) cooling the natural gas stream by indirect heat exchange to thereby provide a cooled natural gas stream;

(b) reducing the pressure of at least a portion of the cooled natural gas stream to thereby provide an expanded natural gas stream;

(c) warming at least a portion of the expanded natural gas stream via indirect heat exchange with the natural gas stream cooled in step (a) to thereby provide a warmed expanded natural gas stream; and (d) removing nitrogen from at least a portion of the warmed expanded liquefied natural gas stream.

20. The method according to claim 19; and (e) splitting said warmed expanded natural gas stream into a first portion and a second portion; and (f) conducting the first portion to a methane compressor; and (g) conducting the second portion to the nitrogen removal unit, step (d) including removing nitrogen from the second portion in the nitrogen removal unit.

21. The method according to claim 20, steps (a), (b), and (c) being carried out in a methane cold box.

22. The method according to claim 21, steps (d) and (e) being carried out outside of the methane cold box.

23. The method according to claim 22, step (d) being carried out in a nitrogen cold box spaced from the methane cold box.

24. The method according to claim 21, said methane cold box housing a methane economizer for facilitating indirect heat transfer between a plurality of predominantly methane streams, steps (a) and (c) being carried out in the methane economizer.

25. The method according to claim 19, step (b) including flashing said at least a portion of the cooled natural gas stream to thereby provide an expanded gas-phase stream and an expanded liquid-phase stream.

26. The method according to claim 25; and (h) separating the expanded gas-phase stream and the expanded liquid-phase stream in a separation vessel, step (c) including warming the separated gas-phase stream from the separation vessel.

27. The method according to claim 19, steps (a), (b), (c), and (d) being carried out in a cascade-type LNG facility having at least three sequential cooling cycles, each employing a different refrigerant.

28. The method according to claim 27, said cascade-type LNG facility employing an open-methane refrigeration cycle.

29. The method according to claim 19; and (i) vaporizing liquefied natural gas produced via steps (a)–(d).

30. A method of operating a LNG facility, said method comprising the steps of:

(a) introducing a warmed predominantly methane stream having a temperature warmer than about −50° F. into a nitrogen removal unit;

(b) removing nitrogen from the warmed predominantly methane stream in the nitrogen removal unit; and (c) prior to step (a), warming the warmed predominantly methane stream via indirect heat exchange with a cooled predominantly methane stream.

31. The method according to claim 30, step (c) being performed in a methane cold box.

32. The method according to claim 31, step (b) being performed in a nitrogen cold box spaced from the methane cold box.

33. A method of operating a LNG facility, said method comprising the steps of:

(a) introducing a warmed predominantly methane stream having a temperature warmer than about −50° F. into a nitrogen removal unit; and (b) removing nitrogen from the warmed predominantly methane stream in the nitrogen removal unit, step (b) including the substeps of:

(b1) cooling the warmed predominantly methane stream by indirect heat exchange in a first heat exchanger to thereby provide a first cooled stream;

(b2) separating at least a portion of the first cooled stream into a first separated stream and a second separated stream using a first vessel, said first separated stream containing a higher molar percentage of nitrogen than said first cooled stream, said second separated stream containing a lower molar percentage of nitrogen than said first cooled stream;

(b3) separating at least a portion of the first separated stream into a third separated stream and a fourth separated stream using a second vessel, said third separated stream containing a higher molar percentage of nitrogen than said at least a portion of first separated stream, said fourth separated stream containing a lower molar percentage of nitrogen than said at least a portion of first separated stream; and (b4) using at least a portion of the fourth separated stream to cool the predominantly methane stream by indirect heat exchange in the first heat exchanger.

34. A method of operating a LNG facility, said method comprising the steps of:

(a) introducing a warmed predominantly methane stream having a temperature warmer than about −50° F. into a nitrogen removal unit; and (b) removing nitrogen from the warmed predominantly methane stream in the nitrogen removal unit, step (b) including the substeps of:

(b1) cooling the warmed predominantly methane stream by indirect heat exchange to thereby provide a first cooled stream;

(b2) splitting at least a portion of the first cooled stream into a first split portion and a second split portion;

(b3) conducting at least a portion of the first split portion to a lower section of a first stripper column;

(b4) further cooling at least a portion of the second split portion by indirect heat exchange to thereby provide a second cooled stream; and (b5) conducting at least a portion of the second cooled stream to an upper section of the first stripper column.

35. A method of operating a LNG facility, said method comprising the steps of:

(a) introducing a warmed predominantly methane stream having a temperature warmer than about −50° F. into a nitrogen removal unit; and (b) removing nitrogen from the warmed predominantly methane stream in the nitrogen removal unit, said nitrogen removal unit comprising:

a high-stage indirect heat exchanger having a first high-stage cooling pass and a first high-stage warming pass; and a low-stage heat exchanger having a first low-stage cooling pass and a first low-stage warming pass, said first high-stage warming pass being configured to receive fluid flow from the first low-stage warming pass.

36. A method of operating a LNG facility, said method comprising the steps of:

(a) introducing a warmed predominantly methane stream having a temperature warmer than about −50° F. into a nitrogen removal unit; and (b) removing nitrogen from the warmed predominantly methane stream in the nitrogen removal unit, steps (a) and (b) being carried out in a cascade-type LNG facility having at least three sequential cooling cycles, each employing a different refrigerant.

37. The method according to claim 36, said cascade-type LNG facility employing an open-methane refrigeration cycle.

38. The method according to claim 30; and (d) producing liquefied natural gas; and (e) vaporizing at least a portion of said liquefied natural gas.

39. A method of removing nitrogen from a predominantly methane stream, said method comprising the steps of:

(a) cooling the predominantly methane stream by indirect heat exchange in a first heat exchanger to thereby provide a first cooled stream, wherein the temperature of said predominantly methane stream introduced into said first heat exchanger is warmer than about −50° F.;

(b) separating at least a portion of the first cooled stream into a first separated stream and a second separated stream using a first vessel, said first separated stream containing a higher molar percentage of nitrogen than said first cooled stream, said second separated stream containing a lower molar percentage of nitrogen than said first cooled stream;

(c) separating at least a portion of the first separated stream into a third separated stream and a fourth separated stream using a second vessel, said third separated stream containing a higher molar percentage of nitrogen than said at least a portion of the first separated stream, said fourth separated stream containing a lower molar percentage of nitrogen than said at least a portion of the first separated stream; and (d) using at least a portion of the fourth separated stream to cool the predominantly methane stream by indirect heat exchange in the first heat exchanger.

40. The method according to claim 39, said first separated stream exiting an upper portion of the first vessel, said second separated stream exiting a lower portion of the first vessel, said third separated stream exiting an upper portion of the second vessel, said fourth separated stream exiting a lower portion of the second vessel.

41. The method according to claim 39; and (e) separating at least a portion of the fourth separated stream in to a fifth separated stream and a sixth separated stream using a third vessel, said fifth separated stream containing a higher molar percentage of nitrogen than said at least a portion of the fourth separated stream, said sixth separated stream containing a lower molar percentage of nitrogen than said at least a portion of the fourth separated stream.

42. The method according to claim 41, said fifth separated stream exiting an upper portion of the third vessel, said sixth separated stream exiting a lower portion of the third vessel.

43. The method according to claim 41, said fifth separated stream comprising at least about 10 mole percent nitrogen.

44. The method according to claim 41, said fifth separated stream comprising at least about 50 mole percent nitrogen.

45. The method according to claim 41, step (d) including using at least a portion of the sixth separated stream to cool the predominantly methane stream by indirect heat exchange in the first heat exchanger.

46. The method according to claim 41, step (d) including using at least a portion of the fifth separated stream to cool the predominantly methane stream by indirect heat exchange in the first heat exchanger.

47. The method according to claim 41; and (f) using at least a portion of the sixth separated stream to cool at least a portion of the first separated stream by indirect heat exchange in a second heat exchanger.

48. The method according to claim 47; and (g) using at least a portion of the fifth separated stream to cool at least a portion of the first separated stream by indirect heat exchange in the second heat exchanger.

49. The method according to claim 39, step (a) including using a removed-nitrogen stream to cool the predominantly methane stream by indirect heat exchange in the first heat exchanger, said removed-nitrogen stream containing a higher molar percentage of nitrogen than said predominantly methane stream.

50. The method according to claim 49, said removed-nitrogen stream comprising at least about 10 mole percent nitrogen.

51. The method according to claim 23, said removed-nitrogen stream comprising at least about 50 mole percent nitrogen.

52. The method according to claim 39, step (a) including reducing the temperature of the predominantly methane stream at least about 50° F.

53. The method according to claim 39, steps (a) through (d) being carried out in a nitrogen cold box.

54. The method according to claim 53; and (h) simultaneously with steps (a) through (d), passing a substantially-hydrocarbon-free gas stream through the nitrogen cold box.

55. The method according to claim 54; and (i) simultaneously with steps (a) through (d), analyzing the composition of the substantially-hydrocarbon-free gas stream exiting the nitrogen cold box for the presence of hydrocarbons.

56. The method according to claim 54, said substantially-hydrocarbon-free gas stream comprising predominantly nitrogen.

57. A method of removing nitrogen from a predominantly methane stream, said method comprising the steps of:

(a) cooling the predominantly methane stream by indirect heat exchange to thereby provide a first cooled stream;

(b) splitting at least a portion of the first cooled stream into a first split portion and a second split portion;

(c) conducting at least a portion of the first split portion to a lower section of a first stripper column;

(d) further cooling at least a portion of the second split portion by indirect heat exchange to thereby provide a second cooled stream; and (e) conducting at least a portion of the second cooled stream to an upper section of the first stripper column.

58. The method according to claim 57, step (a) including reducing the temperature of the predominantly methane stream at least about 50° F., and step (d) including further reducing the temperature of the second split portion at least about 10° F.

59. The method according to claim 57, step (a) including reducing the temperature of the predominantly methane stream at least about 100° F., and step (d) including further reducing the temperature of the second split portion at least about 25° F.

60. The method according to claim 57, step (a) including using a removed-nitrogen stream to cool the predominantly methane stream by indirect heat exchange, said removed-nitrogen stream containing a higher molar percentage of nitrogen than said predominantly methane stream.

61. The method according to claim 57; and (f) using said first stripper column to separate said at least a portion of the first split portion and said at least a portion of the second split portion into a first separated stream and a second separated stream, said first separated stream containing a higher molar percentage of nitrogen than said at least a portion of the first split portion and said at least a portion of the second split portion, said second separated stream containing a lower molar percentage of nitrogen than said at least a portion of the first split portion and said at least a portion of the second split portion.

62. The method according to claim 61, step (a) including using at least a portion of the second separated stream to cool the predominantly methane stream by indirect heat exchange.

63. An apparatus for liquefying a predominantly methane stream, said apparatus comprising:

(a) a methane cold box including a first cold box inlet and a first cold box outlet;

(b) a methane compressor including a first compressor inlet and a first compressor outlet, said first compressor inlet being configured to receive fluid flow from the first cold box outlet; and (c) a nitrogen removal unit including a nitrogen removal unit inlet, said nitrogen removal unit inlet being configured to receive a drawn-off portion of the predominantly methane stream flowing from the first cold box outlet to the first compressor inlet.

64. The apparatus according to claim 63; and (d) a first refrigeration cycle disposed upstream of the methane cold box, said first refrigeration cycle being operable to cool at least a portion of the predominantly methane stream, said first refrigeration cycle employing a first refrigerant comprising predominantly $C_1$–$C_3$ hydrocarbons, carbon dioxide, or mixtures thereof.

65. The apparatus according to claim 64; and (e) a second refrigeration cycle disposed upstream of the methane cold box an downstream of the first refrigeration cycle, said second refrigeration cycle being operable to cool at least a portion of the predominantly methane stream, said second refrigeration cycle employing a second refrigerant comprising predominantly ethylene, ethane, or mixtures thereof, said first refrigerant comprising predominantly propane, propylene, or mixtures thereof.

66. The apparatus according to claim 63; and (f) a methane economizer disposed in the methane cold box and operable to facilitate indirect heat exchange between a plurality of predominantly methane fluid streams.

67. The apparatus according to claim 66; and (g) an expansion-type cooling cycle disposed in the methane cold box and operable to cool at least a portion of the predominantly methane stream via a plurality of sequential pressure reduction stages.

68. The apparatus according to claim 67, said expansion-type cooling cycle including a first expander for reducing the pressure of at least a portion of the predominantly methane stream, said first expander being configured to receive fluid flow from the first heat exchanger pass, said methane economizer including a first heat exchanger pass being configured to receive fluid from the first cold box inlet, said methane economizer including a second heat exchanger pass configured to receive fluid flow from the first expander and discharge fluid flow to the first cold box outlet.

69. The apparatus according to claim 68, said expansion-type cooling cycle including a first gas-liquid separator configured to receive fluid flow from the first expander, said second heat exchanger pass being configured to receive gaseous fluid flow from the first gas-liquid separator.

70. The apparatus according to claim 63, said methane cold box including a second cold box outlet, said methane compressor including a second compressor inlet, said second compressor inlet being configured to receive fluid flow from the second cold box outlet, said nitrogen removal unit including a first nitrogen removal unit outlet, said second compressor inlet being configured to receive fluid flow from the first nitrogen removal unit outlet.

71. The apparatus according to claim 70, said methane cold box including a third cold box outlet, said methane compressor including a third compressor inlet, said third compressor inlet being configured to receive fluid flow from the third cold box outlet, said nitrogen removal unit including a second nitrogen removal unit outlet, said third compressor inlet being configured to receive fluid flow from the second nitrogen removal unit outlet.

72. The apparatus according to claim 63, said nitrogen removal unit being disposed in a nitrogen cold box spaced from the methane cold box.

73. The apparatus according to claim 63, said nitrogen removal unit comprising:

a high-stage indirect heat exchanger having a first high-stage cooling pass and a first high-stage warming pass, said first high-stage cooling pass being configured to receive fluid flow from the nitrogen removal unit inlet; and a low-stage indirect heat exchanger having a first low-stage cooling pass and a first low-stage warming pass, said first high-stage warming pass being configured to receive fluid flow from the first low-stage warming pass.

74. An apparatus for removing nitrogen from a predominantly methane stream, said apparatus comprising:

(a) a high-stage indirect heat exchanger having a first high-stage cooling pass and a first high-stage warming pass;

(b) a low-stage indirect heat exchanger having a first low-stage cooling pass and a first low-stage warming pass, said first high-stage warming pass being configured to receive fluid flow from said first low-stage warming pass; and (c) a high-stage column having an upper high-stage inlet and lower high-stage inlet, said lower high-stage inlet being configured to receive fluid flow from the first high-stage cooling pass.

75. The apparatus according to claim 74, said high-stage indirect heat exchanger including a second high-stage cooling pass configure to receive fluid flow from the first cooling pass, said upper high-stage inlet being configured to receive fluid flow from the second high-stage cooling pass.

76. The apparatus according to claim 75, said high-stage column having an upper high-stage outlet and a lower high-stage outlet, said high-stage indirect heat exchanger including a second high-stage warming pass configured to receive fluid flow from the lower high-stage outlet.

77. The apparatus according to claim 76; and (d) a low-stage column having an upper low-stage outlet and a lower low-stage outlet, said first low-stage warming pass being configured to receive fluid flow from the lower low-stage outlet.

78. The apparatus according to claim 77, said low-stage indirect heat exchanger including a second low-stage warming pass configured to receive fluid flow from the upper low-stage outlet.

79. The apparatus according to claim 78, said high-stage indirect heat exchanger including a third high-stage warming pass configured to receive fluid flow from the second low-stage warming pass.

80. The apparatus according to claim 79; and (e) an intermediate-stage column having an upper intermediate-stage inlet and a lower intermediate-stage inlet, said upper intermediate-stage inlet being configured to receive fluid flow from the first low-stage cooling pass.

81. The apparatus according to claim 80, said lower intermediate-stage inlet being configured to receive fluid flow from the upper high-stage outlet.

82. The apparatus according to claim 81, said intermediate-stage column including an upper intermediate-stage outlet and a lower intermediate-stage outlet, said lower low-stage inlet being configured to receive fluid flow from the lower intermediate-stage outlet.

83. The apparatus according to claim 82, said low-stage indirect heat exchanger including a second low-stage cooling pass configured to receive fluid flow from the upper intermediate-stage outlet.

84. The apparatus according to claim 83, said upper low-stage inlet being configured to receive fluid flow from the second low-stage cooling pass.

85. An apparatus for removing nitrogen from a predominantly methane stream, said apparatus comprising:

(a) a high-stage indirect heat exchanger having a first high-stage cooling pass and a first high-stage warming pass;

(b) a low-stage indirect heat exchanger having a first low-stage cooling pass and a first low-stage warming pass, said first high-stage warming pass being configured to receive fluid flow from said first low-stage warming pass; and (c) a nitrogen cold box housing the high-stage and low-stage indirect heat exchangers.

86. The apparatus according to claim 85; and (d) a hydrocarbon detector operable to detect the presence of hydrocarbons in a substantially-hydrocarbon-free gas, said nitrogen cold box including a purging gas inlet and a purging gas outlet, said hydrocarbon detector being configured to receive fluid flow from the purging gas outlet.

* * * * *